US005843384A

United States Patent [19]

Aussillous et al.

[11] Patent Number: 5,843,384

[45] Date of Patent: Dec. 1, 1998

[54] PLANT FOR PURIFYING SPENT OIL

[75] Inventors: Marcel Aussillous; Patrick Briot; Pierre-Henri Bigeard, all of Vienne; Alain Billon, Le Vesinet, all of France

[73] Assignee: Institut Francais du Petrole, France

[21] Appl. No.: 778,692

[22] Filed: Jan. 3, 1997

Related U.S. Application Data

[62] Division of Ser. No. 543,988, Oct. 17, 1995.

[30] Foreign Application Priority Data

Oct. 17, 1994 [FR] France ..... 94/12.448

[51] Int. Cl.[6] ..... B01D 3/10; B01D 1/00; C10G 7/06

[52] U.S. Cl. ..... 422/189; 196/14.52; 196/100; 196/106; 196/114

[58] Field of Search ..... 422/187–188, 422/189; 196/14.52, 46, 100, 139, 114, 106; 208/179, 181, 184, 187

[56] References Cited

U.S. PATENT DOCUMENTS

| | | | |
|---|---|---|---|
| 3,244,614 | 4/1966 | Summer, Jr. | 208/34 |
| 3,723,295 | 3/1973 | Kress | 208/87 |
| 4,406,778 | 9/1983 | Borza et al. | 208/179 |
| 4,797,198 | 1/1989 | Wetzel et al. | 208/179 |
| 4,917,788 | 4/1990 | Rankel et al. | 208/73 |

FOREIGN PATENT DOCUMENTS

| | | |
|---|---|---|
| 0 055 492 | 7/1982 | European Pat. Off. . |
| 2 301 592 | 9/1976 | France . |
| 2 353 631 | 12/1977 | France . |
| 2 414 549 | 8/1979 | France . |
| 2 257 156 | 1/1993 | United Kingdom . |

*Primary Examiner*—Hien Tran

*Attorney, Agent, or Firm*—Millen, White, Zelano & Branigan, P.C.

[57] ABSTRACT

The invention concerns a plant for purifying spent oil, including apparatus for dehydration, preferably by atmospheric distillation, directly followed by vacuum distillation producing a residue and at least one distilled oil fraction. The vacuum residue directly undergoes solvent extraction and the clarified oil obtained and the distilled oil fraction(s) undergo finishing hydrotreatment.

5 Claims, 1 Drawing Sheet

PLANT FOR PURIFYING SPENT OIL

This is a division of application Ser. No. 08/543,988 filed Oct. 17, 1995, now pending.

BACKGROUND OF THE INVENTION

The present invention concerns a plant for purifying spent oil, i.e., a treatment which is intended to produce at least one base oil which can be used again.

Such oils are mineral hydrocarbon oils in particular, normally from oil sources, usually containing various additives such as rust inhibitors, antioxidants, emulsifiers, viscosity control additives, etc., whose properties are degraded after use for a greater or lesser period in an internal combustion engine as lubricants. They then contain substances such as carbonaceous residues, oxidized, substances, water and unburned hydrocarbons and they must then be drained out.

Spent oil contains a multitude of contaminating elements since nearly all the groups in the periodic classification can be represented, as will be explained below.

In addition to the variety of elements present and the wide range of their concentrations in the oil, the fact that each oil has a different source and is thus contaminated in a different way must be taken into account in order to appreciate the difficulty of the problem to be solved.

Thus large quantities of complex mixtures of oils have to be treated.

French patent FR-A-2 301 592 describes a treatment process for such oils which comprises the following steps:

1. Extracting the spent oil with a paraffinic hydrocarbon containing 3 to 6 carbon atoms or a mixture of several of these hydrocarbons, followed by separation of the extract and raffinate phases; the light hydrocarbon used for the extraction is then removed from the extract, for example by stripping.

This extraction is advantageously preceded by heat treatment consisting of removing the light fractions, for example water and petrol, from the oil by heating to a distillation temperature of less than 200° C., for example 120° C. to 150° C. Further known pretreatments are decanting, filtering, centrifuging and neutralising.

2. Distilling the extract, which is free of the light hydrocarbon used for extraction, to separate at least one distilled lubricating oil fraction from an undistilled lubricating oil residue.
3. Hydrogenating the distilled fraction.
4. Treating the residue from the distillation in step (2) with an adsorbent, for example alumina, bauxite, silica, a clay, an activated earth or a silica-alumina.

Unfortunately, it has transpired that treating the residue with an adsorbent results in a loss of oil and a concomitant reduction in the yield of the process. Further, eliminating large quantities of polluted adsorbent (usually by incineration) causes environmental problems.

A further process for regenerating spent oil involves treating with sulphuric acid the cuts obtained during clarification with solvent or vacuum distillation. These cuts, when the acid sludge has been removed, are then treated with adsorbent.

The two processes described produce waste products (acid sludge, adsorbents) whose elimination requires consideration of the ecological restraints connected with environmental protection. Elimination, storage and treatment is thus costly and increases the costs of current processes.

Still further, there is a risk that treatments with acids and adsorbents will be banned in the future.

We now propose a process and plant which does not use acids or adsorbents which thus has a higher oil recovery yield and which can produce improved quality oils which satisfy new quality standards, i.e., oils which may be equivalent to those obtained from by refining.

Further, this simple process, which has a minimum of operations, can be adapted to existing plants.

More precisely, the invention provides a process for purifying spent oil, comprising the steps of dehydration, vacuum distillation, solvent extraction and hydrotreatment, in which:

the dehydrated spent oil is directly vacuum distilled to produce a residue and at least one distilled oil fraction, the vacuum distillation residue directly undergoes the extraction step to obtain a clarified oil and an extraction residue, the distilled oil fraction(s) and the clarified oil are stabilised by hydrotreatment.

BRIEF DESCRIPTION OF THE DRAWING

The description of the invention will be more easily comprehended using the diagram of the process and plant in FIG. 1.

The spent oil feed(s), H with any suspended particles removed by filtering, for example through a sieve, is introduced into dehydration zone 2.

Figure 1:
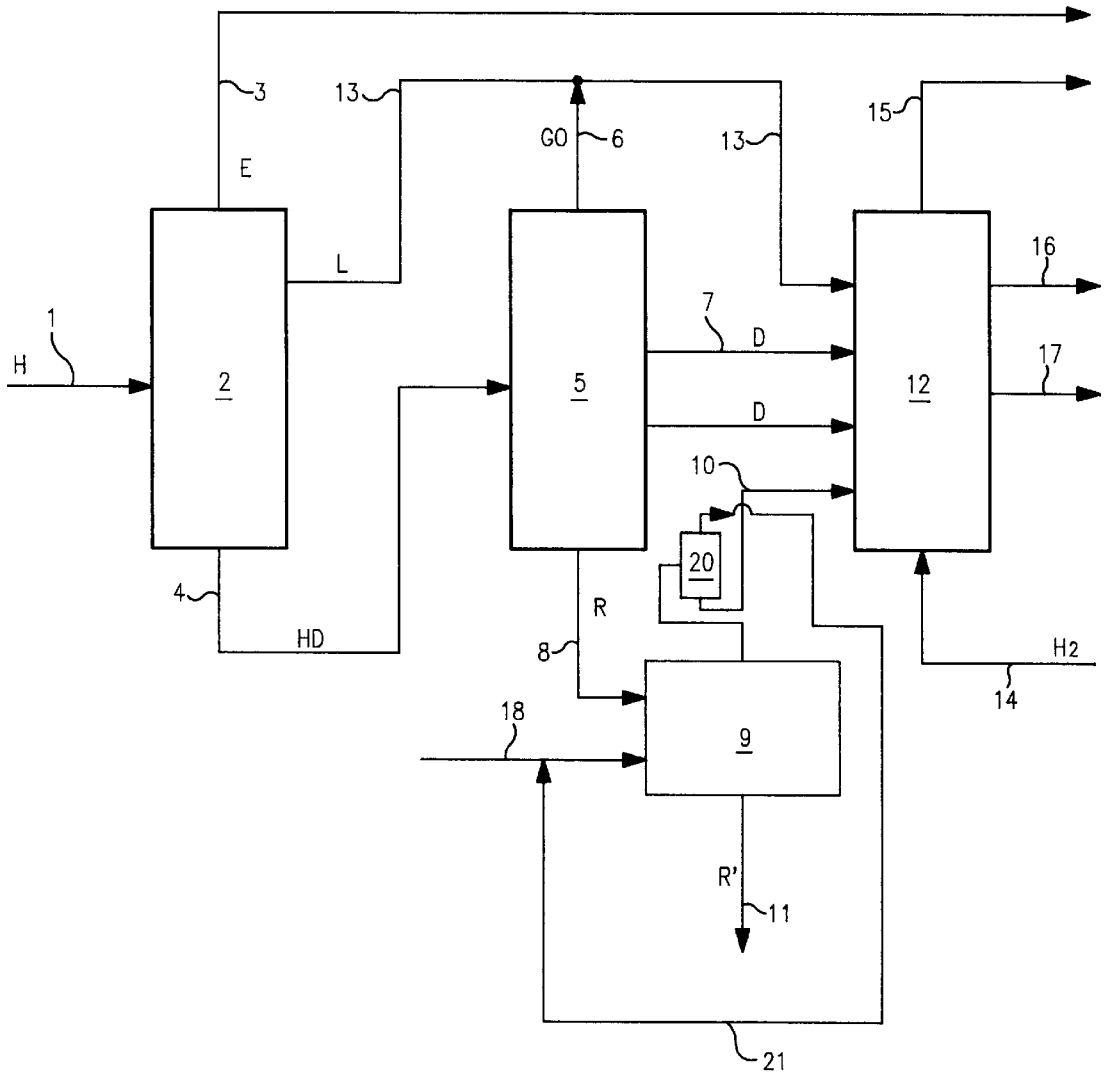

The dehydration techniques are those used in the majority of oil regeneration systems.

Normally, advantageously after preheating the oil in a specially equipped oven, the unprocessed oil is distilled at low temperature to remove water (generally 2% to 4%).

Distillation is carried out at atmospheric pressure or in a slight vacuum in order not to degrade the products. The distillation temperature is less than 240° C., preferably less than 200° C., for example 120° C. to 180° C., or 120°–150° C.

At least a portion of the petrol, (1% to 2%), solvents, glycol, and some additive derivatives can also be eliminated. These light fractions are shown in the Figure at L, and the water at E. Fraction L and the water fraction can be evacuated together or separately.

The dehydrated oil HD obtained is sent directly to a vacuum distillation zone 5, i.e., without extracting the solvent as in the prior art.

This oil feed is heated to a high temperature to carry out an appropriate heat treatment such that the oil is not thermally cracked, but that the dispersing additives are destabilized.

Vacuum distillation produces a residue R and at least one fraction of distilled oil D (which can thus be termed a vacuum distillate).

The vacuum distillation column is advantageously regulated so as to obtain a gas oil (GO) cut overhead, one or more vacuum distillates as side streams and a distillation residue at the bottom. This preferred embodiment is shown in FIG. 1, with two vacuum distillates being produced.

The gas oil cut recovered overhead is very rich in chlorine and contains metals, principally silicon. Its final boiling point is in the range 280° C. to 370° C.

The vacuum distillates contain very little metal and chlorine.

The distilled fraction could be, for example, a spindle fraction (a light oil with a viscosity of close to $20.10^{-6}$ $m^2/s$ at 40° C.) and oil bases for engines such as SSU 100 to 600 oils.

The vacuum residue contains the majority of the metals and metalloids (of the order of 6000 to 25000 ppm, for example) present in the oil, and mainly precipitated polymers. It has an initial boiling point of 450° C. to 500° C.

The vacuum residue is sent to an extraction zone 9 where it is treated, preferably with a paraffinic hydrocarbon containing 3 to 6 carbon atoms or a mixture of several of these hydrocarbons in the liquid state, in order to extract clarified oil from the residue.

Extraction using a light liquid paraffinic hydrocarbon is preferably carried out at a temperature of between 40° C. and the critical temperature of the hydrocarbon at a pressure which is sufficient to maintain the hydrocarbon in the liquid state. With propane, for example, the preferred temperature is between 45° C. and the critical temperature of the hydrocarbon. The extraction zone should have the highest possible temperature gradient. This is why the inlet temperature is lower (less than 70° C., preferably less than 60° C.) The temperature gradient is preferably greater than 20° C., preferably greater than at least 25° C.). The volume ratio of liquid hydrocarbon/oil is 2:1 to 30:1, preferably 5:1 to 15:1. The preferred hydrocarbon is propane.

Generally, the residue must thus be cooled before being introduced into the extraction zone. It is never heated between vacuum distillation and extraction. It is thus said to be sent "directly" to the extraction zone.

The residue is generally brought into contact with the light paraffinic hydrocarbon in continuous fashion in a column (extractor) form which a mixture of paraffinic hydrocarbon and clarified oil is recovered overhead, and an extraction residue R' entraining a portion of the paraffinic hydrocarbon is recovered from the bottom.

Advantageously, the quantity of solvent (paraffinic hydrocarbon) injected into the extractor is divided into two equal or unequal portions. One portion dilutes the feed and regulates the injection temperature of the mixture, and the other portion, injected directly into the column, adjusts the bottom temperature of the column and continues to extract the oil trapped in the residue.

This process is highly efficient due to selective dissolution of the oil in the paraffinic hydrocarbon, and precipitation of an extremely concentrated residue from the bottom of the column. The treatment performs well as regards quality and yield of the viscous oil recovered (Bright Stock: viscosity at 100° C.=$30\times10^{-6}$ to $35\times10^{-6}$ $m^2/s$).

The light paraffinic hydrocarbon is separated from the clarified oil HC and can be recycled to the extraction zone. In a conventional embodiment where the solvent is separated from the oil by vaporising the mixture from the head of the extractor, for example, the light hydrocarbon and the clarified oil are separated by decompression and reheating followed by vapour entrainment. After cooling, compression and condensation, the light hydrocarbon is advantageously recycled for further extraction.

In a further embodiment, the solvent is recovered under supercritical conditions such as those described in FR-A-2 598 717, which is incorporated by reference. In this case, the extraction zone operates at a supercritical pressure which is higher than in the first embodiment (P=35 or 40–70 bar as opposed to 30–40 bar). Phase separation is thus achieved by heating., with no vaporization or condensation. The solvent is then recycled at a supercritical pressure. The advantage of using supercritical conditions is that it eliminates the operations of vaporization and condensation of vapours necessary under classical conditions to recover the solvent.

The mixture from the bottom of the extractor contains the residue portion precipitated in the light hydrocarbon. This mixture has a fairly low viscosity due to the amount of light hydrocarbon it contains. Once the light hydrocarbon is removed, manipulation becomes difficult because of the high viscosity. In order to overcome this problem, the extraction residue containing the solvent extracted from the bottom of the extractor can be mixed with a viscosity reducing agent. After decompression, the ensemble can, for example, be reheated and vapour stripped. After compression and condensation, the light hydrocarbon is recycled to the extraction column. The residue, which is completely free of solvent, can be valorized as a fuel or it can be mixed with bitumens.

The distilled oil fraction(s) and the clarified oil HC are sent (alone or as a mixture) to a hydrotreatment zone 12 where they are treated with hydrogen in the presence of at least one catalyst to finish purification and improve their qualities for better valorization.

This treatment can produce lubricating oils which comply with specifications without the need for treatment with earth and/or with sulphuric acid. These lubricating oils have very good thermal stability and good light stability. The hydrotreatment catalyst(s) have a longer lifetime since the products are fairly pure, having already been through pretreatment operations.

The catalyst is a hydrotreatment catalyst containing at least one oxide or sulphide of at least one group VI metal and/or at least one group VIII metal, such as molybdenum, tungsten, nickel, or cobalt, and a support, for example alumina, silica-alumina or a zeolite.

A preferred catalyst is based on nickel and molybdenum sulphides supported on alumina.

The operating conditions for hydrotreatment are as follows:

- space velocity: 0.1 to 10 volumes of liquid feed per volume of catalyst per hour;
- reactor inlet temperature: between 250° C. and 400° C., preferably between 280° C. and 370° C.;
- reactor pressure: in the range 5 to 150 bar, preferably in the range 15 to 100 bar;
- advantageously, pure $H_2$ recycling: in the range 100 to 2000 $Nm^3/m^3$ of feed.

The hydrotreatment is of high quality because the preceding treatments have produced highly pure vacuum distillates and a "Bright Stock" cut from the clarified oil (with residual metals of less than 5 and 20 ppm respectively).

A final distillation step, if required, allows the cut points to be adjusted.

The gas oil cut obtained from the vacuum distillation step can also be hydrotreated to eliminate chlorine and reduce the sulphur concentration. Advantageously, the gas oil cut can be mixed with the light fractions L obtained from the atmospheric distillation dehydration step.

Hydrotreatment is preferably carried out with the catalysts used to treat the vacuum distillate(s) and the clarified oil. The qualities of the gas oil obtained from this hydrotreatment step successfully comply with all specifications and this cut can be incorporated into fuel storage.

The hydrotreatment in the process of the present invention retains a high degree of activity in the catalyst.

Following hydrotreatment (optionally accompanied by a finishing distillation step), the following is obtained for each of the treated fractions:

- the corresponding oil or oils from the fraction(s) of oil distilled;
- "Bright Stock" from the clarified oil fraction;

a mixture of gas and light hydrocarbons containing purge hydrogen;

optionally, a petrol-gas oil cut from the gas oil cut and the light fractions containing petrol.

The quality of the oils obtained complies with specifications. The oils have highly satisfactory thermal stability and stability to light.

A very slight loss in viscosity is observed with respect to the spent oil feed and in some cases, the pour point is slightly altered.

The metal content is less than 5 ppm, and the chlorine content is less than 5 ppm, usually undetectable.

The polynuclear aromatic compound (PNA) content is normally of the same order as that of the base oils obtained by hydrorefining (of the order of 0.2–0.5% by weight), and can equal that of solvent refined oils (for example furfural), i.e., about 1.5% by weight.

SUMMARY OF THE INVENTION

The invention also concerns a plant for carrying out the process described, comprising:

a dehydration zone (2) provided with an introduction line (1) for the spent oil feed, a line (3) for removal of water and a line (4) for evacuating dehydrated oil;

a line (4 ) which evacuates dehydrated oil from zone (2) and brings it directly to vacuum distillation zone (5);

a vacuum distillation zone (5) into which line (4) opens and which is provided with at least one line (7) for evacuating the distilled oil fraction(s), and at least one line (8) for evacuating vacuum residue;

a hydrotreatment zone (12) provided with at least one line (7, 10, 13) for introducing a cut to be treated, at least one line (16, 17) for evacuating a treated cut, at least one line (14) for supplying hydrogen, and at least one line (15) for removing gas;

an extraction zone (9) provided with a line (18) for introducing solvent, a line (8) for supplying the residue from vacuum distillation zone (5) to zone (9), a line (11) for evacuating extraction residue and a line (10) for removal of clarified oil.

The plant advantageously comprises zone (2), an atmospheric distillation or low vacuum distillation zone, separating the light fraction(s) L containing petrol via line (13). Advantageously, it also comprises a line (6) for evacuating a gas oil cut from vacuum distillation zone (5).

The gas oil, distilled oil and clarified oil fractions can be directly treated in zone (12) (shown in FIG. 1), provided that they are treated separately. They are advantageously stored separately and treated in separate runs.

Hydrogen is directly introduced into the reactor in hydrotreatment zone (12) (as shown in FIG. 1) but it can be introduced with the feed to be treated. The invention includes this possibility within its scope.

A heat exchanger is advantageously located in vacuum residue evacuation line (8), in order to cool the residue.

A means 20 for separating the solvent from the clarified oil is advantageously located after the extraction step, i.e., zone (9). This means is preferably a vaporization means. It is advantageously composed of at least one pressure reducer, a heating means and a vapour entraining apparatus (stripper).

The recovered solvent preferably passes into a heat exchanger, a compressor and a condenser before being recycled for extraction by a suitable line 21 which connects the separation means to extraction zone (9).

In a further embodiment, a heating means which separates the solvent is located at zone (9) under supercritical conditions, along with a line for recycling the solvent to zone (9).

The present invention will now be illustrated using an example of a dehydrated oil with the following analysis:

| Characteristics | | Dehydrated oil |
|---|---|---|
| Density at 15° C. | | 0.892 |
| Colour ASTM D1500 | | 8+ |
| Pour point | °C. | −18 |
| Viscosity at 40° C.* | cSt | 102.11 |
| Viscosity at 100° C.* | cSt | 11.7 |
| Viscosity index | | 102 |
| Total nitrogen | ppm | 587 |
| Sulphur | wt % | 0.63 |
| Chlorine | ppm | 280 |
| Conradson carbon | wt % | 1.56 |
| Sulphated ash | wt % | 0.9 |
| Phosphorous | ppm | 530 |
| Flash open cup | °C. | 230 |
| Neutralization number | mg KOH/g | 0.92 |
| Metals (total) | ppm | 3.445 |
| Ba | ppm | 10 |
| Ca | ppm | 1114 |
| Mg | ppm | 324 |
| B | ppm | 16 |
| Zn | ppm | 739 |
| P | ppm | 603 |
| Fe | ppm | 110 |
| Cr | ppm | 5 |
| Al | ppm | 20 |
| Cu | ppm | 18 |
| Sn | ppm | 1 |
| Pb | ppm | 319 |
| V | ppm | 1 |
| Mo | ppm | 3 |
| Si | ppm | 31 |
| Na | ppm | 129 |
| Ni | ppm | 1 |
| Ti | ppm | 1 |

*viscosity is expressed in cSt (centistokes); 1 cSt = $10^{-6}$ $m^2/s$.

The water removed on atmospheric distillation represented 4% by weight of the feed and the light fraction L, 2.4% by weight.

The dehydrated oil (93.6% of the feed) was sent to the vacuum distillation unit: in the example, we combined the two side stream distillates. Distillates 1+2 corresponded to boiling points of between 280° C. and 565° C. Distillates 1+2 were sent to the hydrotreatment unit, and the vacuum residue was sent to the solvent clarification unit (extraction zone (9)). Analysis of the products from the vacuum distillation step showed the following:

| Characteristics | | VD cut (1 + 2) | VR cut |
|---|---|---|---|
| Density, 15° C. | | 0.8768 | 0.9302 |
| Colour ASTM D1500 | | 8 | black |
| Pour point | °C. | −9 | −15 |
| Viscosity at 40° C.* | cSt | 49.39 | 959.5 |
| Viscosity at 100° C.* | cSt | 7.12 | 55.96 |
| Viscosity index | | 101 | 111 |
| Total nitrogen | ppm | 180 | 1535 |
| Sulphur | wt % | 0.47 | 1.00 |
| Chlorine | ppm | 45 | 830 |
| Phosphorous | ppm | 15 | 1740 |
| Conradson carbon | wt % | 0.08 | 5 |
| Flash open cup | °C. | 231 | 283 |
| Sulphated ash | wt % | 0.005 | 3 |
| Sediment | ppm | 0.05 | 0.6 |
| Neutralization number | | | |
| Total acid | mg KOH/g | 0.14 | |
| Strong acid | mg KOH/g | 0 | |
| Base | mg KOH/g | 0.24 | |
| Metals (total) | ppm | ≈11 | 11444 |

-continued

| Characteristics | | VD cut (1 + 2) | VR cut |
|---|---|---|---|
| Ba | ppm | <1 | 30 |
| Ca | ppm | <1 | 3711 |
| Mg | ppm | <1 | 1077 |
| B | ppm | <1 | 51 |
| Zn | ppm | <1 | 2462 |
| P | ppm | 6 | 1995 |
| Fe | ppm | <1 | 365 |
| Cr | ppm | <1 | 15 |
| Al | ppm | <1 | 64 |
| Cu | ppm | <1 | 59 |
| Sn | ppm | <1 | 22 |
| Pb | ppm | <1 | 1060 |
| V | ppm | <1 | 2 |
| Mo | ppm | <1 | 7 |
| Si | ppm | 3 | 95 |
| Na | ppm | 2 | 425 |
| Ni | ppm | <1 | 2 |
| Ti | ppm | <1 | 2 |

*1 cSt = $10^{-6}$ $m^2/s$.

The bottom cut (vacuum residue) obtained during vacuum distillation was sent to the solvent extraction unit.

The operating conditions for this operation were as follows:

| | |
|---|---|
| Total solvent/oil ratio: | 8/1 |
| Light hydrocarbon: | propane |
| Overhead extractor temperature: | 85° C. |
| Bottom extractor temperature: | 55° C. |
| Pressure: | 39 bar |

Following extraction, the light hydrocarbon was separated from the residue by vaporization. The residue obtained was fluxed (mixed with dehydrated oil or with a viscosity-reducing hydrocarbon) and could be used as a fuel or as a binder in asphalt cements.

The clarified oil was separated from the light hydrocarbon by vaporization to produce a Bright Stock cut (BS).

| Characteristics | | VR | BS clarified with C3 |
|---|---|---|---|
| Density, 15° C. | | 0.9302 | 0.895 |
| Colour ASTM D1500 | | black | 8+ |
| Pour point | °C. | −15 | −9 |
| Viscosity at 40° C.* | cSt | 959.5 | 377 |
| Viscosity at 100° C.* | cSt | 55.96 | 25.40 |
| Viscosity at 150° C. | cSt | | |
| Viscosity index | | 111 | 89 |
| Total nitrogen | ppm | 1535 | 375 |
| Sulphur | wt % | 1.00 | 0.786 |
| Chlorine | ppm | 830 | 20 |
| Phosphorous | ppm | 1740 | 15 |
| Conradson carbon | wt % | 5 | 0.60 |
| Flash open cup | °C. | 283 | 332 |
| Sulphated ash | wt % | 30 | <0.005 |
| Sediment | ppm | 0.6 | <0.05 |
| Neutralization number | | | |
| Tota1 acid | mg KOH/g | | 0.3 |
| Strong acid | mg KOH/g | | 0.0 |
| Base | mg KCH/g | | 0.55 |
| Metals (total) | ppm | 11444 | ≈19 |
| Ba | ppm | 30 | <1 |
| Ca | ppm | 3711 | 1 |
| Mg | ppm | 1077 | <1 |
| B | ppm | 51 | 1 |
| Zn | ppm | 2462 | 1 |
| P | ppm | 1995 | <1 |
| Fe | ppm | 365 | <1 |

-continued

| Characteristics | | VR | BS clarified with C3 |
|---|---|---|---|
| Cr | ppm | 15 | <1 |
| Al | ppm | 64 | <1 |
| Cu | ppm | 59 | <1 |
| Sn | ppm | 22 | 6 |
| Pb | ppm | 1060 | <1 |
| V | ppm | 2 | <1 |
| Mo | ppm | 7 | <1 |
| Si | ppm | 95 | 7 |
| Na | ppm | 425 | 3 |
| Ni | ppm | 2 | <1 |
| Ti | ppm | 2 | <1 |

*1 cSt = $10^{-6}$ $m^2/s$.

The mixture of vacuum distillates 1+2 and Bright Stock oil were respectively (separately) sent to the hydrotreatment unit over a catalyst containing nickel sulphide, molybdenum sulphide and an alumina support.

The operating conditions were as follows:

| | |
|---|---|
| Temperature: | 300/280° C. |
| Partial pressure of hydrogen: | 50 bar |
| Residence time: | 1 hour |
| Hydrogen recycle: | 380 $Nm^3/m^3$ of feed |

The quality of the products from this hydrotreatment step are compared with those of the respective feeds in the table below:

| Characteristics | | VD cut (1 + 2) | Hydrogenated VD cut (1 + 2) | BS cut | Hydro-genated BS cut |
|---|---|---|---|---|---|
| Density, 15° C. | | 0.8768 | 0.872 | 0.895 | 0.893 |
| Colour ASTM D1500 | | 8− | 1− | 8+ | 2.5 |
| Pour point | °C. | −9 | −6 | −9 | −6 |
| Viscosity at 40° C.* | cSt | 49.39 | 47.39 | 377 | 373.48 |
| Viscosity at 100° C.* | cSt | 7.12 | 7.00 | 25.40 | 25.10 |
| Viscosity index | | 101 | 104 | 89 | 88 |
| Total nitrogen | ppm | 180 | 65 | 315 | 217 |
| Sulphur | wt % | 0.47 | 0.182 | 0.786 | 0.443 |
| Chlorine | ppm | 45 | 0 | 20 | 0 |
| Phosphorous | ppm | 15 | 0 | 15 | 0 |
| Conradson carbon | wt % | 0.08 | 0.014 | 0.60 | 0.39 |
| Flash open cup | °C. | 231 | 220 | 332 | 309 |
| Neutralization number | | | | | |
| Total acid KOH/g | mg | 0.14 | 0.06 | 0.3 | 0.02 |
| Strong acid KOH/g | mg | 0.0 | 0.0 | 0.0 | 0.0 |
| Base KOH/g | mg | 0.24 | 0.13 | 0.55 | 0.36 |
| Polycyclic aromatics | wt % | | <0.5 | | <0.5 |
| Metals (total) | ppm | 11 | 1 | 19 | 1 |
| Ba | ppm | 0 | 0 | 0 | 0 |
| Ca | ppm | 0 | 0 | 1 | 0 |
| Mg | ppm | 0 | 0 | 0 | 0 |
| B | ppm | 0 | 0 | 1 | 0 |
| Zn | ppm | 0 | 0 | 1 | 0 |
| P | ppm | 6 | 0 | 0 | 0 |
| Fe | ppm | 0 | 0 | 0 | 0 |
| Cr | ppm | 0 | 0 | 0 | 0 |
| Al | ppm | 0 | 0 | 0 | 0 |
| Cu | ppm | 0 | 0 | 0 | 0 |
| Sn | ppm | 0 | 0 | 6 | 0 |
| Pb | ppm | 0 | 0 | 0 | 0 |
| V | ppm | 0 | 0 | 0 | 0 |
| Mo | ppm | 0 | 0 | 0 | 0 |
| Si | ppm | 3 | 0 | 7 | 1 |
| Na | ppm | 2 | 1 | 3 | 0 |
| Ni | ppm | 0 | 0 | 0 | 0 |
| Ti | ppm | 0 | 0 | 0 | 0 |

*1 cst = $10^{-6}$ $m^2/s$.

The products obtained from the hydrotreatment step are characterised by a reduction in the heavy aromatics content, a large reduction in the sulphur content, and total elimination of chlorine and metals. The viscosity index of these oil bases is retained or improved, and the stability to heat or light is very high.

The extraction unit is thus very suitable for treatment of the vacuum residue cut; it also necessitates only a third of the investment required for a plant for clarifying total oil after dehydration, since the capacity of the unit is reduced to a about third of that required in the prior art.

Oil extraction after dehydration has been observed not to produce as high a quality of oil: the metals contained in clarified oil are in amounts of more than 300 ppm.

It may thus be that extraction is even better when the medium treated is concentrated in metals and heavy molecules.

The molecules containing the metals (impurities) precipitate readily from the solvent medium, and the high concentration of metals (degraded additives) produces insoluble micelles which gradually increase in size as the residence time in the column increases. They fall to the bottom of the extractor due to differences in density.

The present invention, which has illustrated and exploited this effect, allows all the products contained in the collected spent oil to be valorized to the maximum The valorizable product yield is close to 99% with respect to the quantity of hydrocarbon in the collected oil. There are no liquid or solid substances to be incinerated as is the case with other processes. The residue leaving the extraction step can also be valorized.

We claim:

1. A plant for purifying spent oil, comprising:

dehydrating means (2) provided with an inlet line (1) for feeding spent oil, a line (3) for removal of water and a line (4) for evacuating dehydrated oil;

a vacuum distillation column (5) into which said line (4) for evacuating hydrated oil enters and said column being provided with at least one line (7) for evacuating distilled oil fraction(s), and at least one line (8) for evacuating vacuum residue;

hydrotreatment means (12) directly connected to said vacuum distillation column (5) via said at least one line (7), said hydrotreatment means being provided with at least one line (16, 17) for evacuating a treated oil cut, at least one line (14) for supplying hydrogen, and at least one line (15) for removing gas;

solvent extraction means (9);

wherein said line (4) for evacuating dehydrated oil from dehydrating means (2) is directly connected to said vacuum distillation column (5); and said extraction means (9) being provided with a line (18) for introducing solvent, said at least one line (8) supplying the vacuum residue from vacuum distillation column (5) to said extraction means (9), a line (11) for evacuating extraction residue and a line (10) for removal of clarified oil.

2. A plant according to claim 1, wherein dehydrating means (2) comprises a distillation column provided with a line (13) for removing a light fraction containing petrol, and wherein the distillation column (5) comprises a line (6) for evacuating gas oil cut therefrom.

3. A plant according to claim 1 further comprising separating means (20) located between said extraction means (9) and said hydrotreatment means (12) for separating the solvent from the clarified oil, and a line connecting said separating means to the extraction means (9) for recycling the solvent.

4. A plant for purifying spent oil as claimed in claim 1, wherein said vacuum residue is directly sent from said vacuum distillation column (5) to said extraction means (9) by a direct connection thereto.

5. A plant for purifying spent oil, comprising:

dehydrating means (2) provided with an inlet line (1) for feeding spent oil, a line (3) for removal of water and a line (4) for evacuating dehydrated oil;

a vacuum distillation column (5) into which said line (4) for evacuating hydrated oil enters and said column being provided with at least one line (7) for evacuating distilled oil fraction(s), and at least one line (8) for evacuating vacuum residue;

hydrotreatment means (12) into which said line (7) for evacuating distilled oil fraction enters as a spent oil cut to be treated, said hydrotreatment means being provided with at least one line (16, 17) for evacuating a treated cut, at least one line (14) for supplying hydrogen, and at least one line (15) for removing gas;

solvent extraction means (9);

wherein said line (4) for evacuating dehydrated oil from dehydrating means (2) is directly connected to said vacuum distillation column (5);

said extraction means (9) being provided with a line (18) for introducing solvent, said at least one line (8) supplying the vacuum residue from vacuum distillation column (5) to said extraction means (9), a line (11) for evacuating extraction residue and a line (10) for removal of clarified oil;

wherein said vacuum residue is directly sent from said vacuum distillation column (5) to said extraction means (9); and wherein said line (7) for evacuating distilled oil fraction (s) is a direct connection between said vacuum distillation column (5) and said hydrotreatment means (12).

* * * * *